US006142834A

United States Patent [19]

Liao

[11] Patent Number: 6,142,834

[45] Date of Patent: Nov. 7, 2000

[54] ELECTRIC JACK WITH A PIVOTED COVER

[76] Inventor: Sheng-Hsin Liao, No. 10, Alley 38, Lane 229 Sanchun St., Shulin Town, Taipei County, Taiwan

[21] Appl. No.: 09/346,908

[22] Filed: Jul. 2, 1999

[30] Foreign Application Priority Data

Apr. 23, 1999 [TW] Taiwan ..... 88206366

[51] Int. Cl.[7] ..... H01R 24/00

[52] U.S. Cl. ..... 439/676; 439/638; 439/131; 379/438

[58] Field of Search ..... 439/142, 344, 439/131, 540.1, 638, 676, 669, 701; 379/438

[56] References Cited

U.S. PATENT DOCUMENTS 6,005,774 12/1999 Chiba et al. ..... 361/737
6,012,953 1/2000 Francis ..... 439/676
6,031,909 2/2000 Daoud ..... 379/438
6,045,393 4/2000 Alpert ..... 439/418

*Primary Examiner*—Khiem Nguyen
*Attorney, Agent, or Firm*—Rosenberg, Klein & Lee

[57] ABSTRACT

An electric jack for the connection of a module plug for signal transmission, including a base, and a cover pivoted to the base, wherein the base has two parallel side walls, a raised block on the middle, two longitudinal grooves at two opposite sides of the raised block, two pivot pins at two opposite sides of the raised block, two tongues respectively raised from the side walls, a plurality of metal terminals mounted in respective insertion slots in the raised block, a stop block for supporting the inserted module plug; the cover has two front pivot holes respectively coupled to the pivot pins at the raised block, two parallel rails at a bottom side wall thereof for guiding the inserted module plug into position, two retaining blocks for engagement with two stop edges at the clip of the inserted module plug, and two locating grooves for engagement with the tongues at the side walls of the base to hold the cover in the closed position.

4 Claims, 10 Drawing Sheets

ELECTRIC JACK WITH A PIVOTED COVER

BACKGROUND OF THE INVENTION

The present invention relates to an electric jack, and more particularly to such an electric jack which can be opened for the insertion of a module plug, or closed to reduce its dimension when not in use.

FIG. 15 is an exploded view of an electric connector according to the prior art. This structure of electric connector comprises two module jack shells 5, each module jack shell 5 having a respective insertion slot 51 into which a module plug 4 can be inserted, two terminal holders 511 respectively mounted in the module jack shells 5, each terminal holder 511 holding a set of metal terminals 512, and a set of conductors 513 connected between the metal terminals 512 at the terminal holders 511. This structure of electric connector needs much installation space. Furthermore, the assembly process of this structure of electric connector is complicated, and its manufacturing cost is high.

SUMMARY OF THE INVENTION

It is one object of the present invention to provide an electric jack which can be opened for the insertion of a module plug, or closed to reduce its dimension when not in use. It is another object of the present invention to provide an electric jack which has fastening means for enabling two electric jacks to be fastened together. According to one aspect of the present invention, the electric jack comprises a base, and a cover pivoted to the base, wherein the base has two parallel side walls, a raised block on the middle, two longitudinal grooves at two opposite sides of the raised block, two pivot pins at two opposite sides of the raised block, two tongues respectively raised from the side walls, a plurality of metal terminals mounted in respective insertion slots in the raised block, a stop block for supporting the inserted module plug; the cover has two front pivot holes respectively coupled to the pivot pins at the raised block, two parallel rails at a bottom side wall thereof for guiding the inserted module plug into position, two retaining blocks for engagement with two stop edges at the clip of the inserted module plug, and two locating grooves for engagement with the tongues at the side walls of the base to hold the cover in the closed position. According to another aspect of the present invention, hooks and hook holes are provided at the back side wall of the base, so that two electric jacks can be fastened together by hooking the hooks at one electric jack in the hook holes at the other. According to an alternate form of the present invention, the back has pins and pin holes at its one end, so that two electric jacks can be longitudinally connected in a line by plugging the pins at one electric jack into the pin holes at the other.

DETAILED DESCRIPTION OF THE PREFERRED EMBODIMENT

Figure 1:
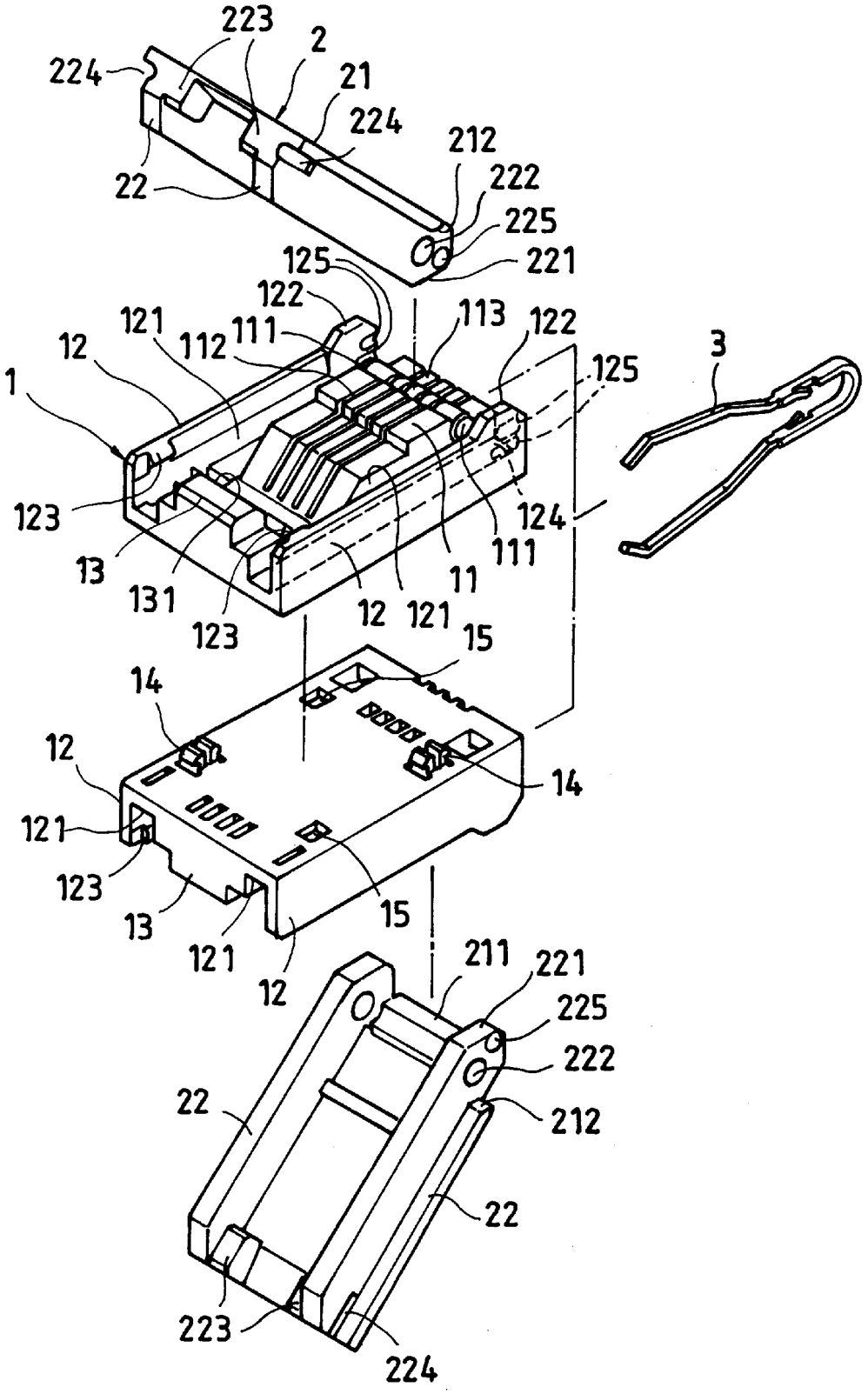
FIG. 1 is an exploded view of two electric jacks constructed according to the present invention.
Figure 2:
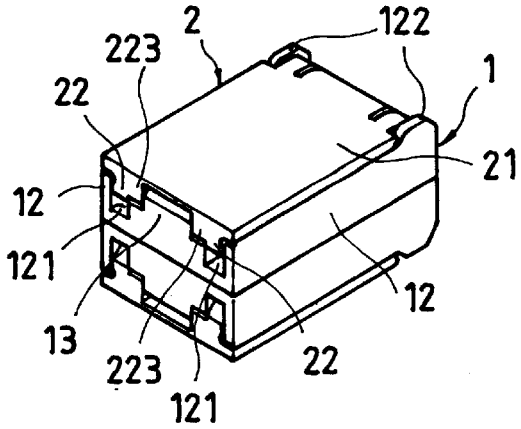
FIG. 2 is an assembly view of the electric jacks shown in FIG. 1.
Figure 3:
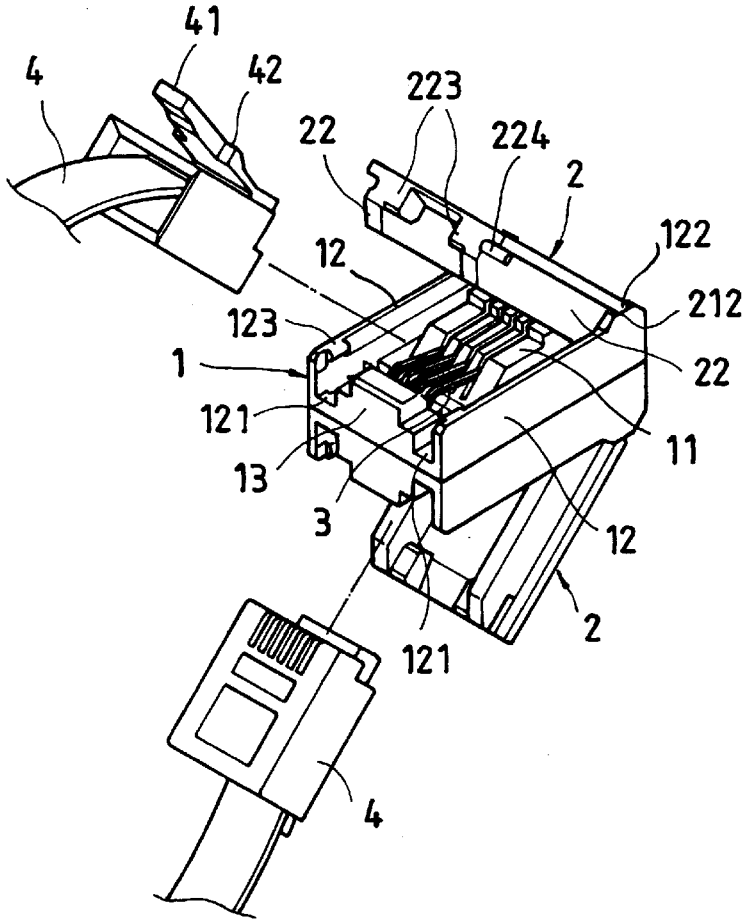
FIG. 3 shows the electric jacks opened for the insertion of a respective module plug according to the present invention.
Figure 4:
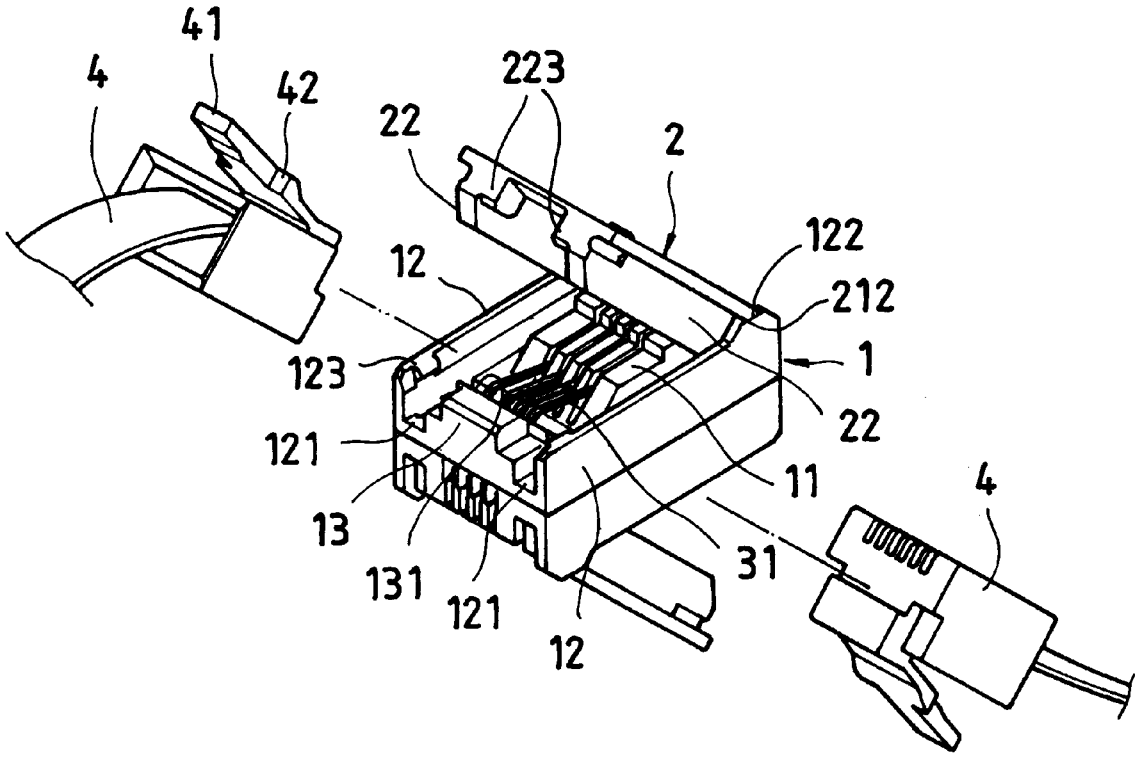
FIG. 4 shows an alternate form of the present invention where two electric jacks are connected in reversed directions.
Figure 8:
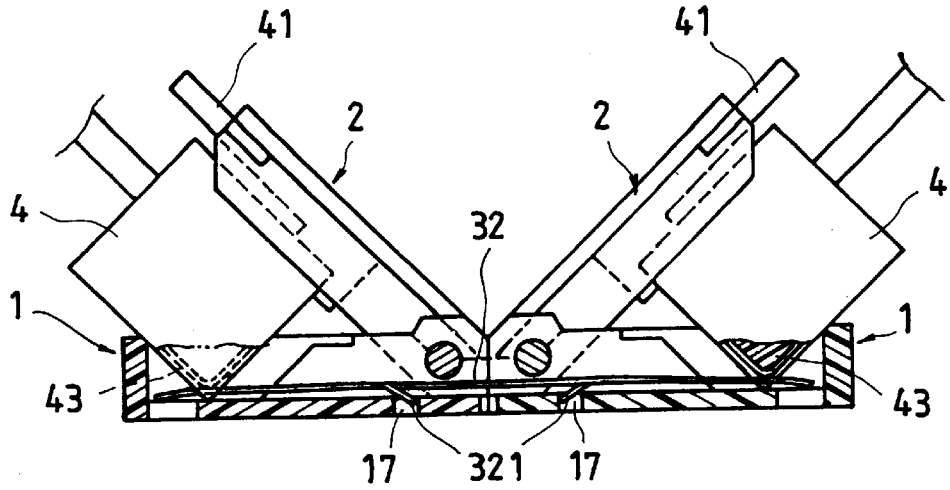
FIG. 8 is a sectional view of the embodiment shown in FIG. 7.

Referring to FIGS. 1, 2 and 3, an electric jack is shown comprised of a base 1, and a cover 2. The base 1, comprises two parallel side walls 12, a raised block 11 on the middle between the side walls 12, two longitudinal grooves 121 at two opposite sides of the raised block 11 between the side walls 12, two pivot pins 111 aligned at two opposite sides of the raised block 11, and two recessed portions 125 respectively disposed at the side walls 12 on the inside at one end, namely, the front end. The cover 2 is pivoted to the raised block 11 for closing the base 1, having two pivot holes 222 bilaterally disposed at one end, namely, the front end thereof and respectively coupled to the pivot pins 111 at the raised block 11. The cover 2 comprises two parallel rails 22 longitudinally disposed at the bottom side wall thereof for guiding a module plug 4 into position, two retaining blocks 223 raised from the bottom side wall at one end, namely, the rear end thereof between the rails 22 for engagement with two stop edges 42 at the clip 41 of the inserted module plug 4, two raised portions 225 respectively raised from the rails 22 on the outside at one end, namely, the front end for engagement with the recessed portions 125 at the base 1, and two locating grooves 224 respectively provided at the rails 22 on the outside at one end, namely, the rear end. Beveled stop edges 211, 212 and 221 are respectively formed at the top wall 21 and rails 22 of the cover 2 at one end. When the cover 2 is opened from the base 1, the beveled stop edges 211, 212 and 221 are respectively stopped at respective beveled stop edges 113, 122 and 124 at the raised block 11 and the longitudinal grooves 121 in the base 1 to limit outward turning angle of the cover 2 relative to the base 1, and at the same time, the raised portions 225 at the cover 2 are respectively engaged into the recessed portions 125 at the base 1, causing the cover 2 to be retained in the opened position. The base 1 further comprises a stop block 13 transversely disposed at the rear end between the longitudinal grooves 121, and two tongues 123 respectively inwardly raised from the side walls 12 at the rear end. The stop block 13 has a front slope 131 for supporting the inserted module plug 4 in position. When the cover 2 is closed, the rails 22 are received in the longitudinal grooves 121 inside the base 1, and the locating grooves 224 are respectively forced into engagement with the tongues 123 at the base 1, thereby causing the cover 2 to be firmly retained in the closed position. Further, metal terminals 3 are respectively mounted in parallel insertion slots 112 and 132 at the raised block 11 and the stop block 13 for signal transmission to the inserted module plug 4 (the insertion slots 132 are not shown), and hooks 14 and hook holes 15 are provided at the back side of the base 1 for enabling two module jacks to be fastened together.

Figure 5:
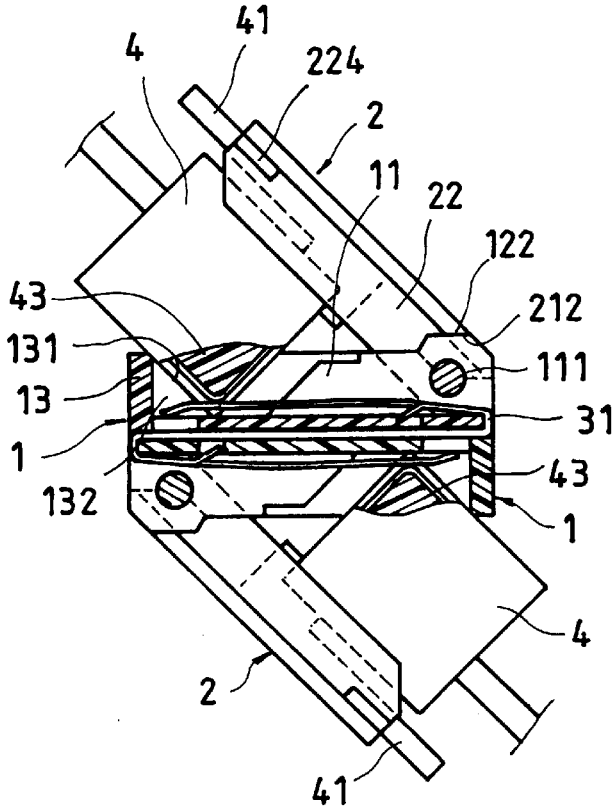
FIG. 5 is a sectional view of the embodiment shown in FIG. 4.
Figure 6:
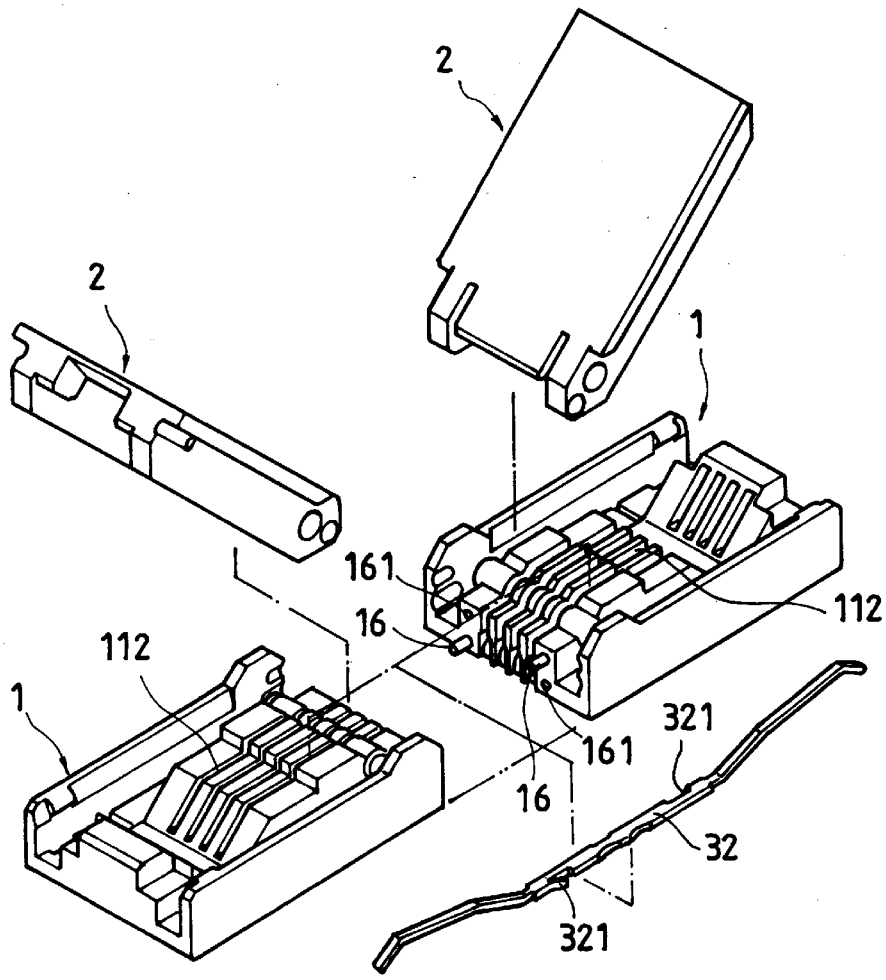
FIG. 6 is an exploded view of another alternate form of the present invention, showing end-to-end connected between two electric jacks.
Figure 7:
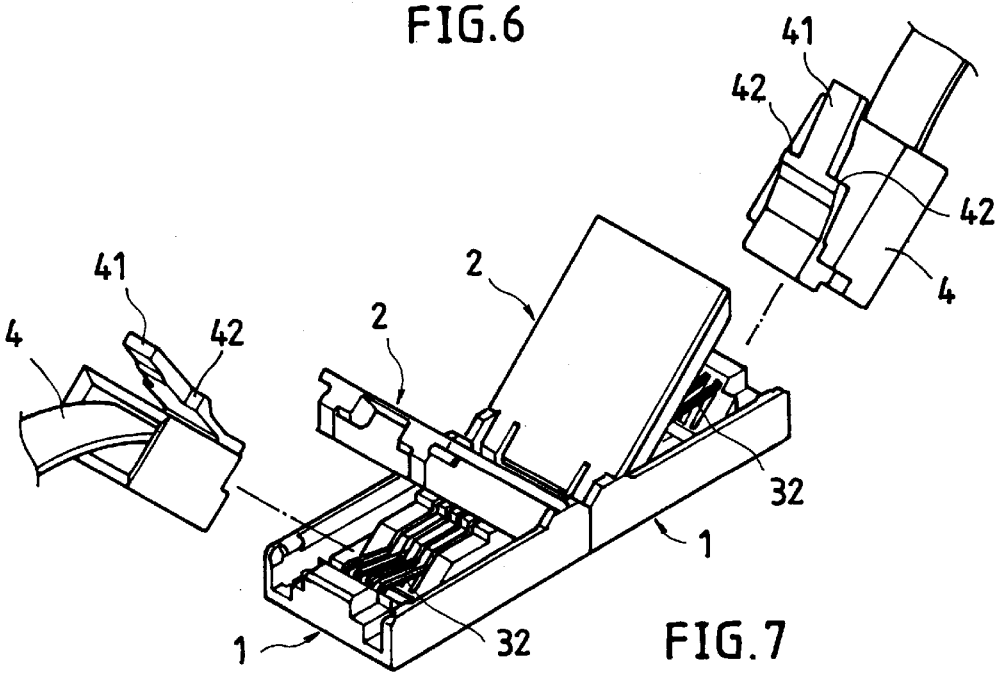
FIG. 7 is an assembly view of the embodiment shown in FIG. 6.

FIG. 5 shows an alternate form of the present invention, in which two electric jacks are fastened together back to back in reversed directions, and the metal terminals 31 each have two horizontally suspended opposite ends respectively inserted into the insertion slots 112 and 132 in the raised blocks 11 and stop blocks 13 of the two electric jacks. When two module plugs 4 are respectively inserted into the electric jacks, the metal terminals 43 of the module plugs 4 are respectively disposed in contact with the metal terminals 31 to receive signal from the module jacks.

Figures from 6 through 8 show another alternate form of the present invention, in which two electric jacks are longitudinally connected in a line. According to this alternate form, the base 1 of each electric jack comprises pins 16 and pin holes 161 at the front side. By means plugging respective pins 16 into respective pin holes 161, the electric jacks are connected together. Further, the metal terminals 32 are mounted in the insertion slots 112 in each base 1 of the electric jacks, each having two hooked portions 321 respectively hooked in a respective bottom hook hole 17 at the base 1 of each of the electric jacks.

Figure 11:
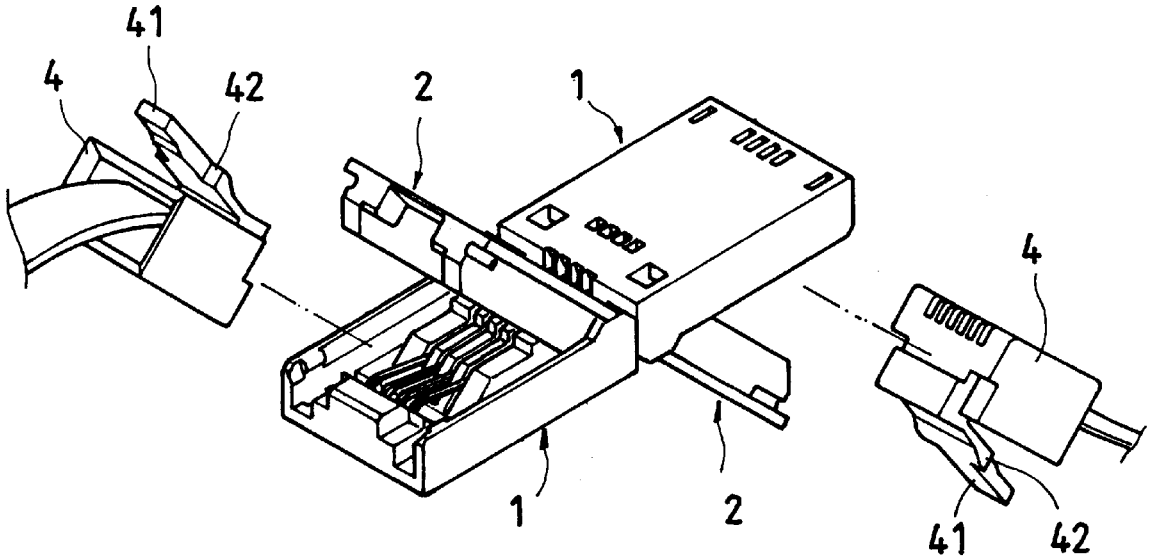
FIG. 11 illustrates still another alternate form of the present invention where two electric jacks are reversely connected end-to-end.
Figure 12:
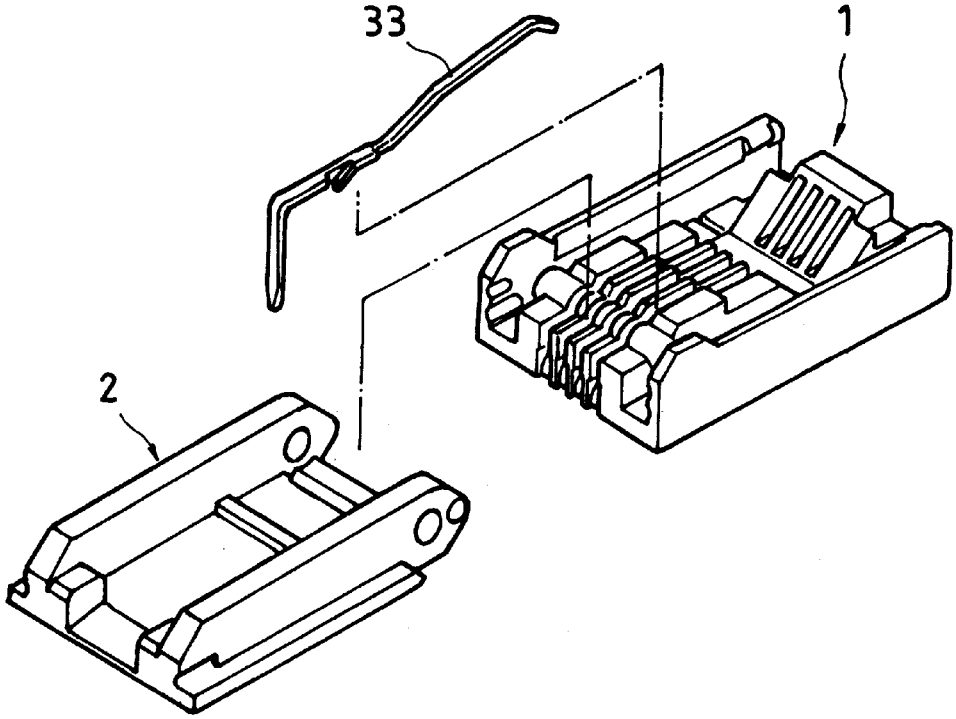
FIG. 12 is an exploded view of still another alternate form of the present invention.
Figure 13:
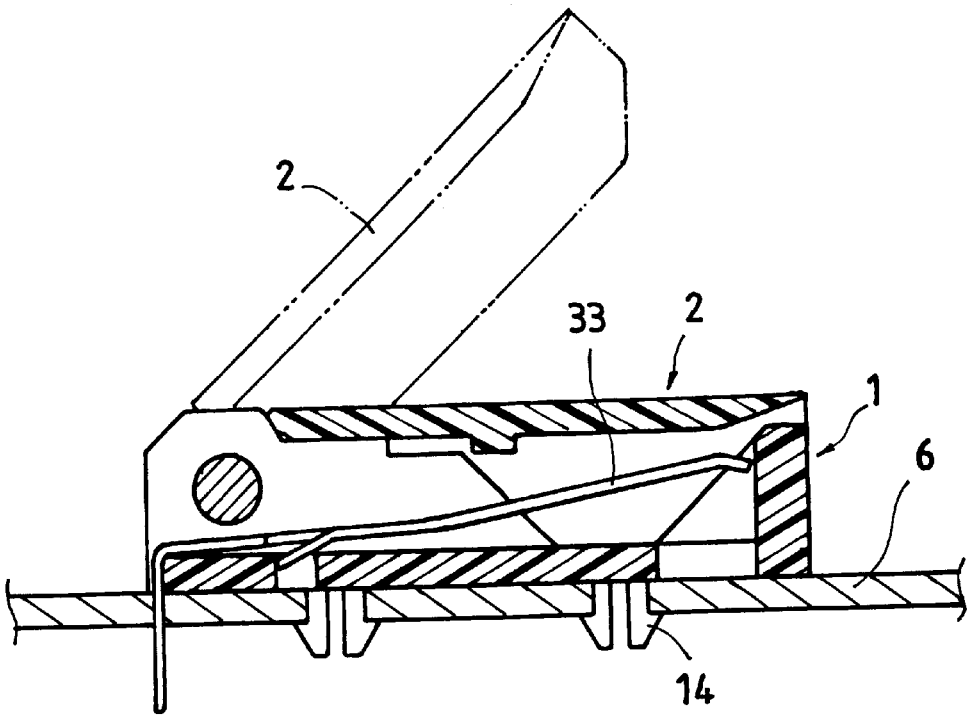
FIG. 13 is a sectional view showing the embodiment of FIG. 12 installed in a circuit board.
Figure 14:
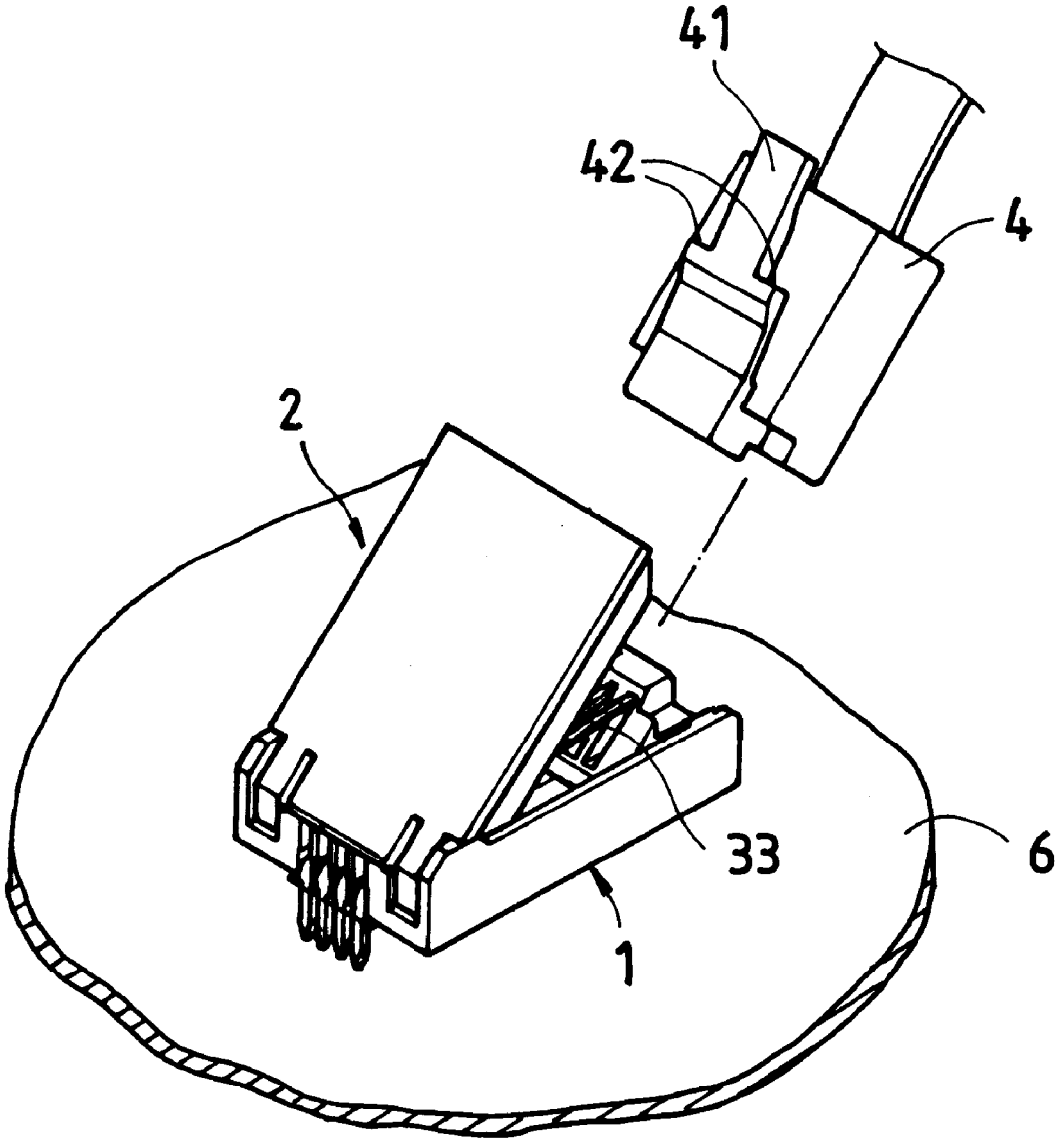
FIG. 14 is an elevational view of the embodiment shown in FIG. 12.
Figure 15:
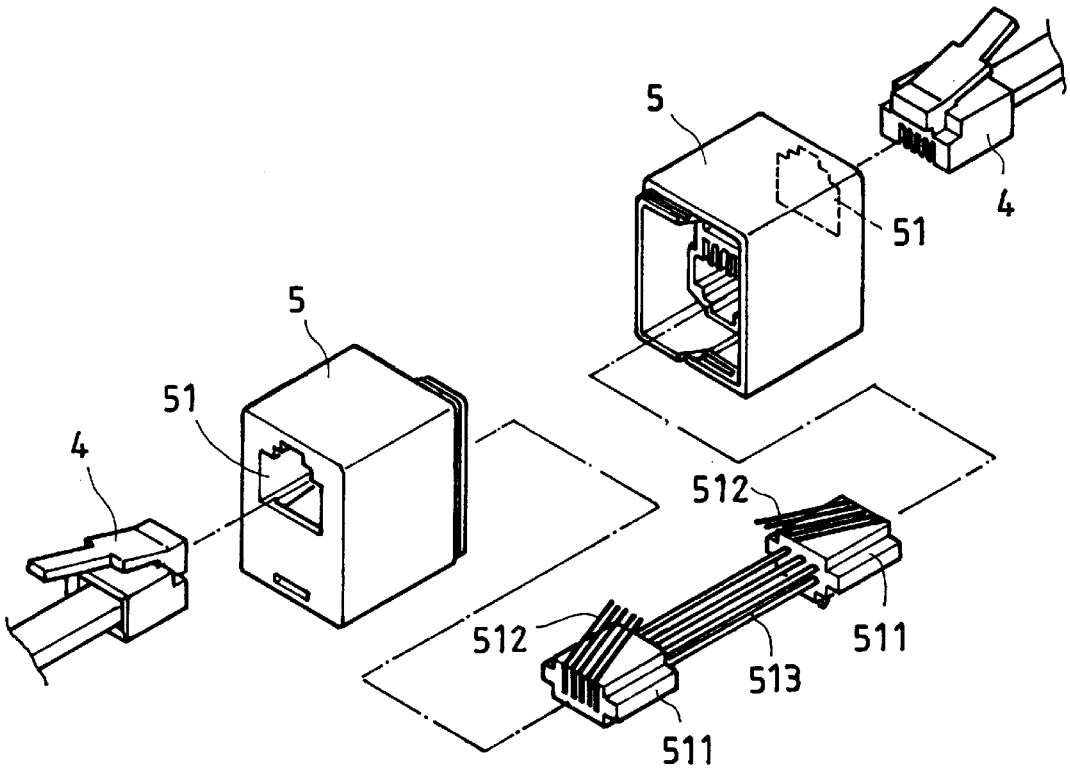
FIG.15 PRIOR ART
FIG. 15 is an exploded view of an electric connector according to the prior art.
Figure 16:
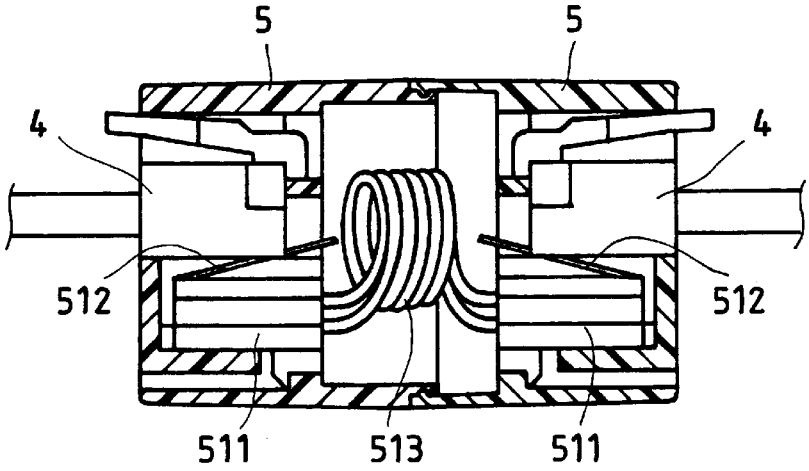
FIG.16 PRIOR ART
FIG. 16 is a sectional assembly view in an enlarged scale of the electric connector shown in FIG. 15.

FIG. 11 shows still another alternate form of the present invention. This alternate form is similar to the embodiment shown in Figures from 6 through 8. However, in Figures from 6 through 8, the two electric jacks are longitudinally connected together with the respective cover 2 disposed at the same side. In FIG. 11, a first electric jack is turned upside down, and then connected to the second electric jack.

Figure 9:
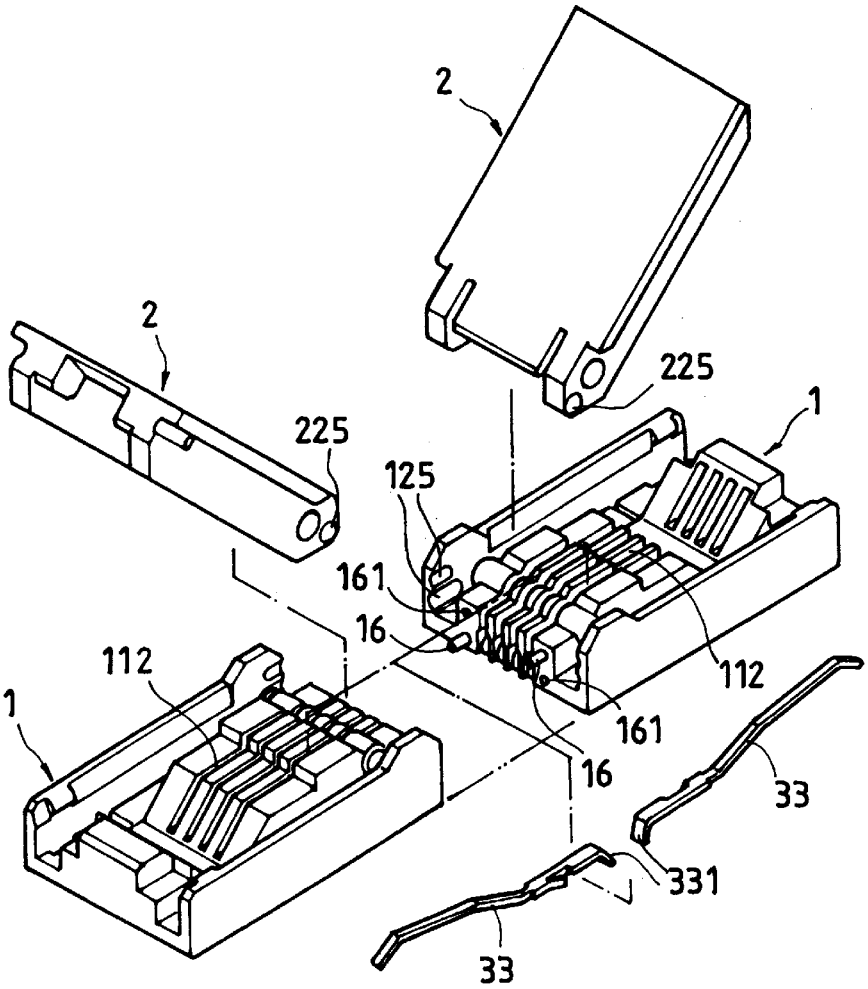
FIG. 9 is an exploded view of still another alternate form of the present invention.
Figure 10:
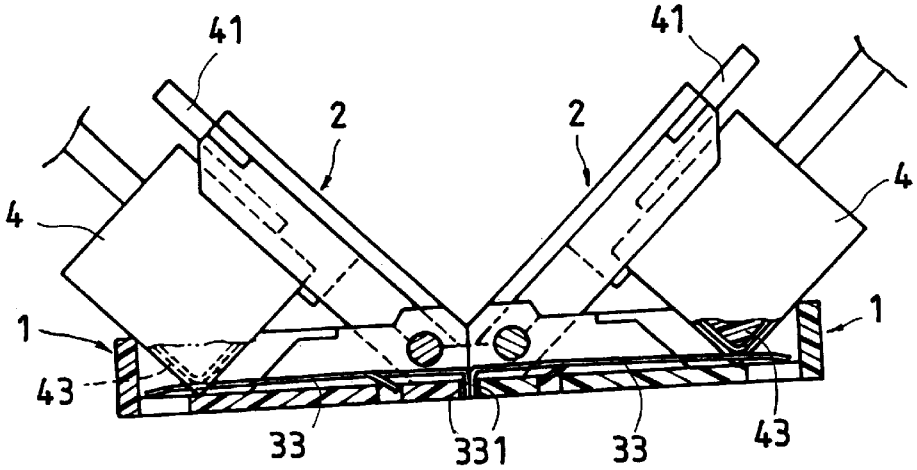
FIG. 10 is a sectional assembly view of the embodiment shown in FIG. 9.

FIGS. 9 and 10 show still another alternate form of the present invention. This alternate form is similar to the embodiment shown in Figures from 6 through 8, however the electric jacks are provided with respective metal terminals 33, and the metal terminals 33 each have a curved front contact portion 331. When installed, the curved front contact portions 331 of the metal terminals 33 in one electric jack are respectively disposed in contact with the curved front contact portions 331 of the metal terminal 33 in the other electric jack.

Figures from 12 through 14 show still another alternate form of the present invention. According to this alternate form, the base 1 has bottom mounting hooks 14 respectively hooked in respective mounting holes at a circuit board 6, and the metal terminals 33 each have an angled connecting end respectively fastened to respective contact hole at the circuit board 6.

It is to be understood that the drawings are designed for purposes of illustration only, and are not intended as a definition of the limits and scope of the invention disclosed.

What the invention claimed is:

1. An electric jack comprising:

a base, said base comprising two parallel side walls, a raised block on the middle between said side walls, said raised block having a beveled front stop edge two longitudinal grooves at two opposite sides of said raised block between said side walls, two pivot pins aligned at two opposite sides of said raised block, two tongues respectively inwardly raised from said side walls, parallel insertion slots at said raised block, a plurality of metal terminals respectively mounted in said insertion slots, a stop block transversely disposed at a rear end thereof between said longitudinal grooves, said stop block having a front slope; and a cover pivoted to said raised block, said cover comprising two pivot holes bilaterally disposed at a front end thereof and respectively coupled to the pivot pins at said raised block of said base, two parallel rails longitudinally disposed at a bottom side wall thereof corresponding to the longitudinal grooves in said base for guiding a module plug into contact with the metal terminals in said base, said rails each having a beveled front edge, two retaining blocks raised from the bottom side wall at one end between said rails for engagement with two stop edges at the clip of the inserted module plug, and two locating grooves respectively provided at said rails on the outside for engagement with the tongues at the side walls of said base to hold said cover in position when said cover is closed on said base.

2. The electric jack of claim 1 wherein said base comprises two recessed portions respectively provided at said side walls at an inner side, and said cover comprises two raised portions respectively raised from said rails on the outside for engagement with the recessed portions at said base to hold said cover in an opened position.

3. The electric jack of claim 1 wherein said base comprises two hook holes and two hooks respectively diagonally provided at a back side wall thereof such that two electric jacks can be connected together by hooking the hooks at one electric jack in the hook holes at the other.

4. The electric jack of claim 1 wherein said base comprises a set of pins and a set of pin holes at one end thereof such that two electric jacks can be connected in a line by plugging the pins at one electric jack into the pin holes at the other.

* * * * *